US009254006B2

(12) United States Patent
Abdallah

(10) Patent No.: US 9,254,006 B2
(45) Date of Patent: Feb. 9, 2016

(54) PORTABLE CIGAR ASHTRAY

(76) Inventor: Michael Abdallah, Royal Oak, MI (US)

( * ) Notice: Subject to any disclaimer, the term of this patent is extended or adjusted under 35 U.S.C. 154(b) by 595 days.

(21) Appl. No.: 13/545,509

(22) Filed: Jul. 10, 2012

(65) Prior Publication Data

US 2013/0015086 A1 Jan. 17, 2013

Related U.S. Application Data

(60) Provisional application No. 61/506,325, filed on Jul. 11, 2011.

(51) Int. Cl.

| | |
|---|---|
| ***A24F 9/14*** | (2006.01) |
| ***A24F 19/00*** | (2006.01) |
| ***A24F 19/02*** | (2006.01) |

(52) U.S. Cl.

CPC ..... *A24F 19/0035* (2013.01); *A24F 19/02* (2013.01)

(58) Field of Classification Search

CPC ..... A24F 13/22; A24F 19/00; A24F 19/02; A24F 19/0035

USPC ..... 131/257, 242.6

See application file for complete search history.

(56) References Cited

U.S. PATENT DOCUMENTS 1,727,582 A * 9/1929 Caldwell ..... 131/260

OTHER PUBLICATIONS

"International Audi A5-S5 Owners Club" Forum, "Also Hate Cupholders?" posting, http://www.a5oc.com/forums/a5-s5-topics/4688-also-hate-cupholders.html, printed from the Internet of Mar. 26, 2015.*

Advertisement disclosed at the Tobacco Expo, Mar. 10, 2010.

* cited by examiner

*Primary Examiner* — Richard Crispino
*Assistant Examiner* — Dionne Walls Mayes
(74) *Attorney, Agent, or Firm* — Dinsmore & Shohl LLP; Douglas L. Wathen

(57) ABSTRACT

A portable cigar ashtray includes a cup-shaped base portion having a closed bottom, a side wall extending upwardly from the closed bottom, and an open top. A resting platform is disposed inside the cup-shaped base portion and spaced from the closed bottom. A retaining assembly is disposed near an upper end of the cup-shaped base portion and includes a retaining ring and a nub holder.

10 Claims, 4 Drawing Sheets

PORTABLE CIGAR ASHTRAY

REFERENCE TO RELATED APPLICATIONS

This patent application claims priority from U.S. provisional patent application Ser. No. 61/506,325, filed Jul. 11, 2011, the entire content of which is incorporated herein in its entirety.

FIELD OF THE INVENTION

The present invention relates generally to ashtrays and, more specifically, to an ashtray designed to be portable and for use with cigars.

BACKGROUND OF THE INVENTION

People that smoke cigarettes, cigars, and pipes typically use ashtrays both to rest or hold the cigarette, cigar, or pipe and to catch and hold ash. Traditionally, ashtrays were provided in cars and a variety of public places, but have become less available over time. Additionally, traditional ashtrays, even when provided, are generally not properly sized or shaped to hold a cigar. Unlike cigarettes, a cigar takes an extended period of time to smoke and the smoker may wish to rest the cigar on or in an ashtray for an extended period and for the cigar to be supported in a stable position.

SUMMARY OF THE INVENTION

The present invention provides an ashtray that is designed to be both portable and for use with cigars. It includes a cup-shaped base portion and an optional detachable lid. The cup-shaped base portion has a resting platform near the bottom for resting the lit end of an elongated cigar. The ashtray further includes a retaining ring near the upper end of the cup-shaped base portion for stabilizing the elongated cigar when the lit end is resting on the resting platform and the body of the cigar passes through the retaining ring. The ashtray further includes a nub holder positioned towards the upper end of the cup-shaped portion. The nub holder supports the lit end of a short cigar or nub so that the nub does not fall down into the bottom of the cup-shaped portion.

According to one embodiment of the present invention, a portable cigar ashtray includes a cup-shaped base portion with closed bottom, a side wall extending upwardly from the closed bottom and an open top. A resting platform is positioned inside the cup-shaped base portion and spaced from the closed bottom. A retaining assembly is positioned near an upper end of the cup-shaped base portion and includes a retaining ring and a nub holder.

DETAILED DESCRIPTION OF THE INVENTION

Figure 1:
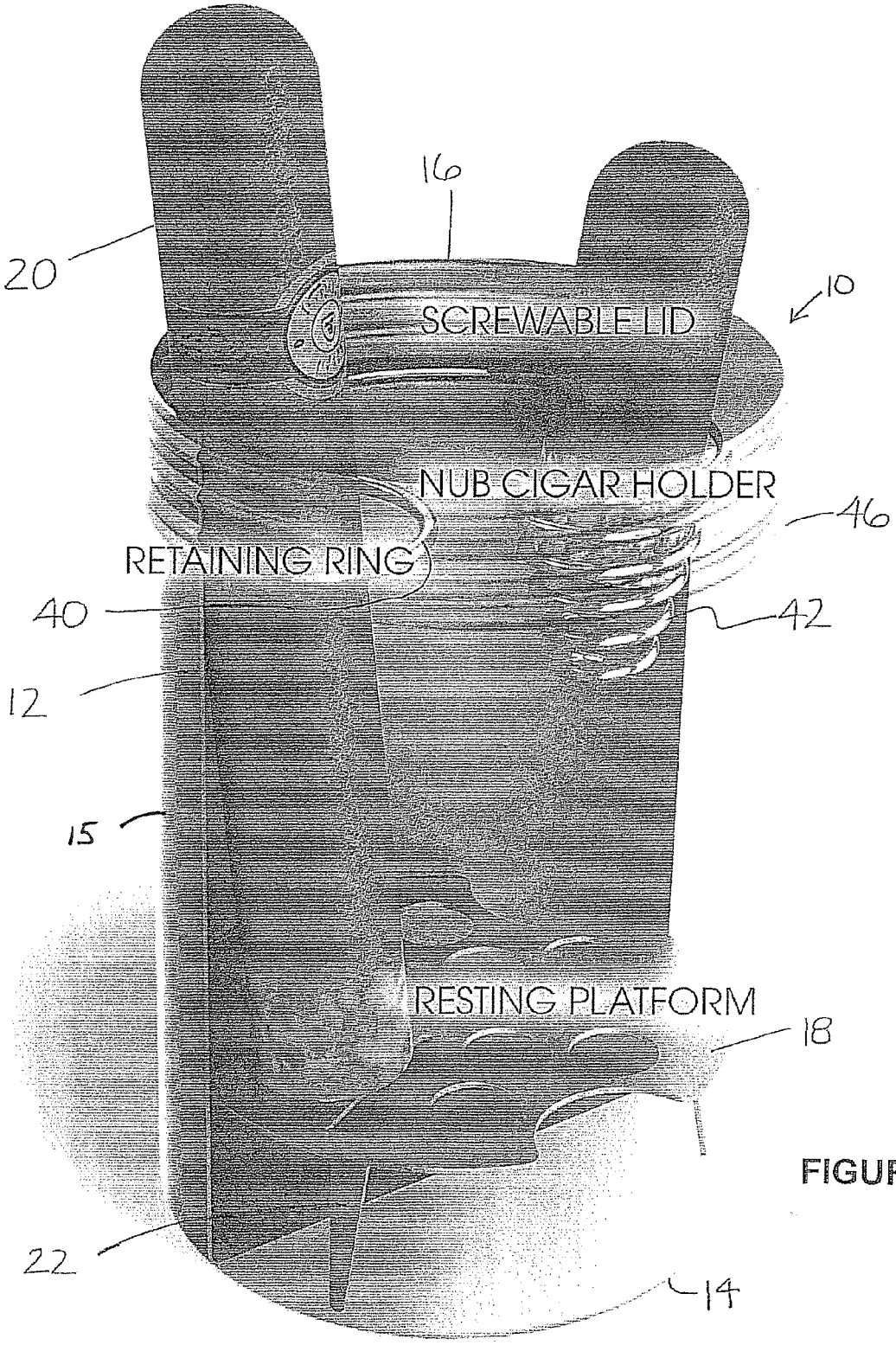
FIG. 1 is a perspective view of an embodiment of the present invention.

Referring to FIG. 1, a first embodiment of a portable cigar ashtray according to the present invention is shown at 10. The ashtray 10 is shown as partially transparent to illustrate internal features. However, it is understood that the ashtray is typically constructed of an opaque material, preferably such as stainless steel. The ashtray includes a cup-shaped base portion 12 with a closed bottom 14 and an open top 16 with a generally cylindrical side wall 15 extending therebetween. An optional lid, not illustrated, may be provided which is detachably connected to the open upper end 16 so as to close and seal the ashtray. In the illustrated embodiment, the upper end of the cup-shaped base portion 12 has threads for engagement by the lid, which is also threaded.

The ashtray 10 further includes a resting platform 18 that is spaced from the closed bottom 14 of the cup-shaped base portion 12. The resting platform is designed to support the lit end of an elongated cigar, such as cigar 20. As shown, the resting platform has openings therethrough to allow ash from the cigar 20 to pass through the platform and fall to the closed bottom 14. The openings also allow for cleaning and removal of ash. In the illustrated embodiment, the resting platform has legs 22 that support it off the closed bottom 14. The resting platform 18 may be supported in other ways, including by the side walls of the cup-shaped base portion. Preferably, the resting platform is permanently positioned so that it does not fall out during cleaning. The benefit of the resting platform is that the lit end of the cigar is supported away from its own discarded ash, since the ash falls through the platform.

Figure 3:
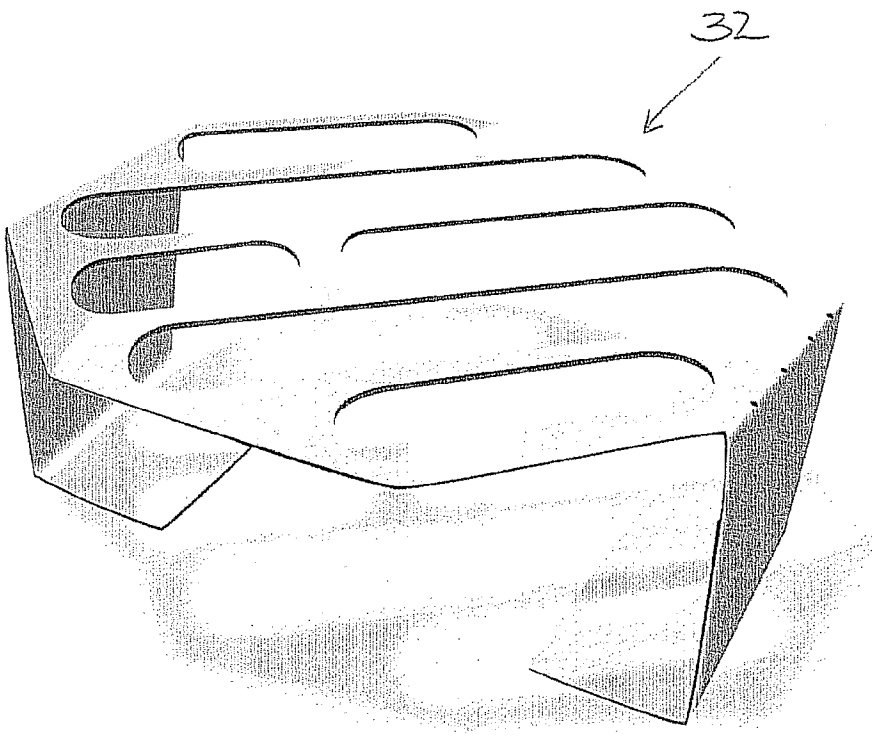
FIG. 3 is a perspective view of a resting platform.
Figure 2:
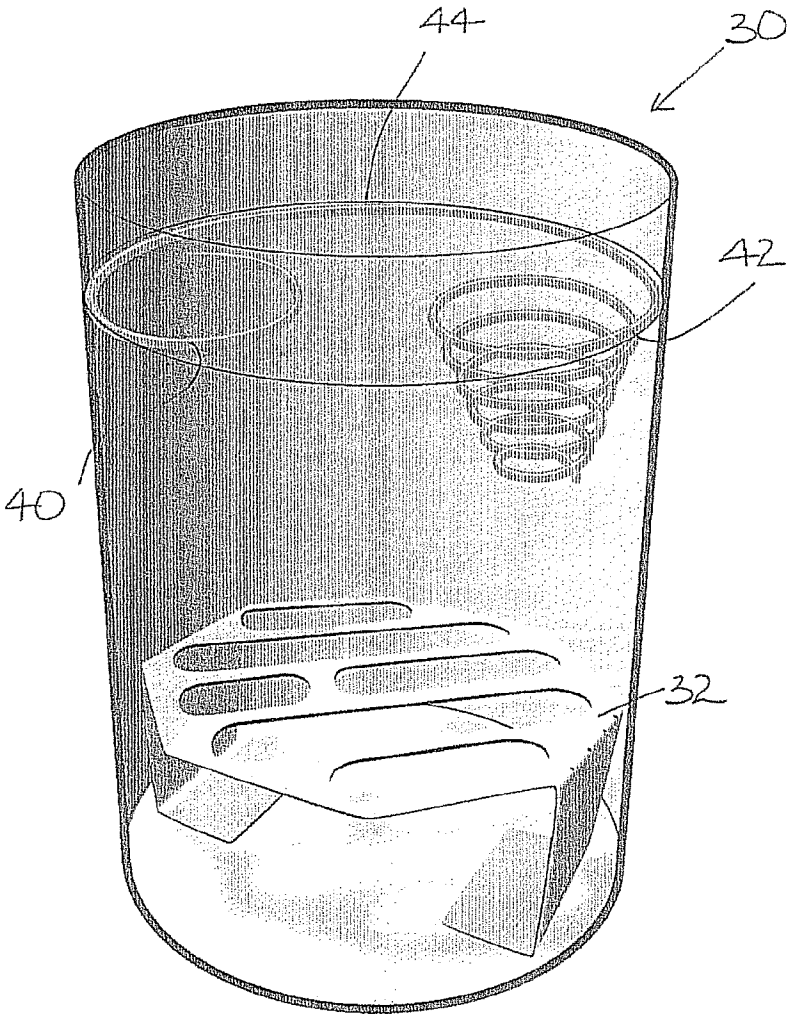
FIG. 2 is a perspective view of another embodiment of the present invention.
Figure 4:
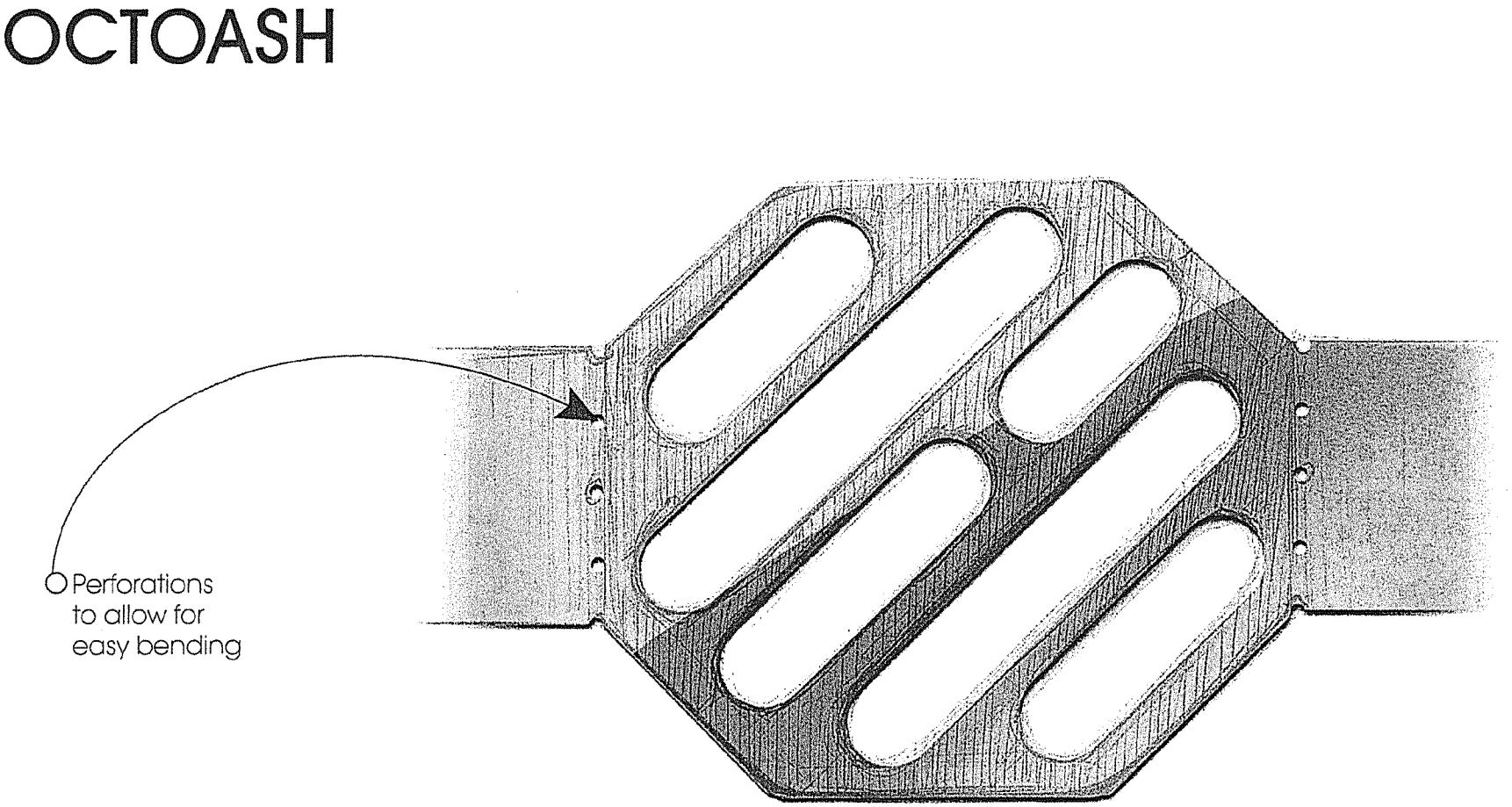
FIG. 4 is a view of the platform before bending.
Figure 6:
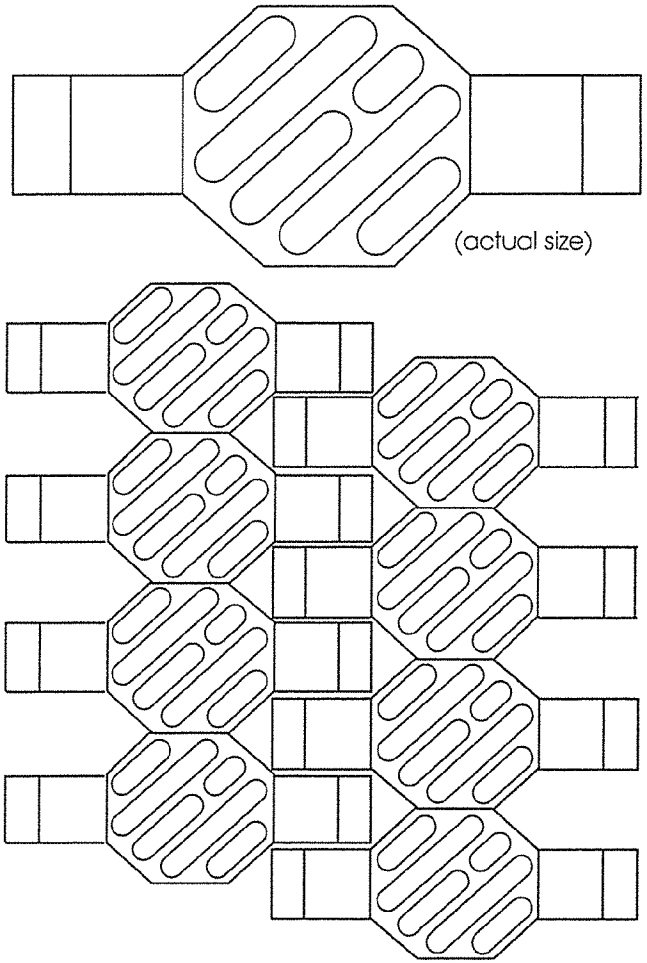
FIG. 6 is a view of multiple platforms.
Figure 5:
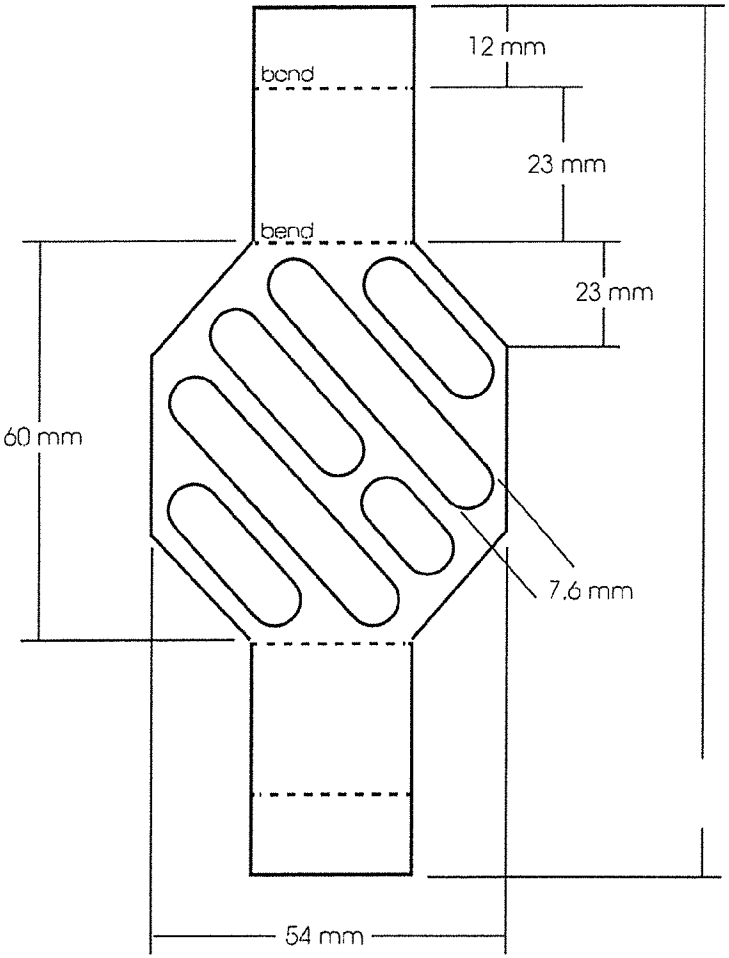
FIG. 5 is a view of the platform with exemplary dimensions.

Referring now to FIG. 2, an alternative embodiment of an ashtray 30 is shown with a different design of resting platform 32. FIG. 3 provides a detailed view of the resting platform 32. It has an upper portion that is perforated and a pair of feet that extend downwardly from the upper portion. The feet are designed to be bonded to the bottom of the cup-shaped base portion so as to retain the platform 32 on the bottom of the ashtray. FIG. 4 provides a detailed view of the platform 32 prior to bending into shape, including perforations that may be included to allow for easy bending. FIG. 5 illustrates the platform 32, before bending, and illustrates dimensions that may be used for some embodiments. It should be understood that these dimensions are not limiting on the present invention. FIG. 6 illustrates how a plurality of platforms may be stamped from a single sheet.

Referring again to FIG. 1, the cup-shaped base portion 12 has a height that is chosen such that a freshly cut and lit cigar 20 may have its lit end resting on the resting platform 18 and it will not easily fall out of the ashtray. In some embodiments, the cup-shaped base portion has an overall height of approximately 10 centimeters with the resting platform positioned 2 to 2½ centimeters from the bottom. As such, some embodiments of the present invention are sized such that the side walls of the cup-shaped base portion 12 extend at least 7 to 8 centimeters above the resting platform for adequately supporting the cigar 20. In further embodiments, the cup-shaped base portion has a height in the range of 8 to 12 centimeters.

Preferred embodiments of the present invention are sized so as to fit in a cup holder of an automobile, boat, golf cart, or other apparatus. As such, these embodiments are generally cylindrical in shape and have a diameter between 6½ and 7 centimeters. In further embodiments, the diameter of the closed bottom and the open top are both in the range of 5 to 10 centimeters and more preferably 6 to 8 centimeters. Preferably, the side walls are generally perpendicular to the closed bottom. As will be clear to those of skill in the art, somewhat different sizes may be provided and other cross-sectional shapes, such as an octagon, may be used.

Referring again to FIGS. 1 and 2, the ashtray 10 or 30 includes a retaining ring 40 positioned inside the cup-shaped base portion near the upper end. The retaining ring is designed to stabilize the body of the cigar 20 when the lit end is resting on the resting platform. This limits movement of the cigar especially where the ashtray 10 is being used in a vehicle in motion. The retaining ring 40 is sized to receive the body of a typical cigar. In some embodiments, the retaining ring has a diameter of approximately 3 centimeters. In some embodiments, the retaining ring is positioned approximately 1 to 1½ centimeters from the upper end of the cup-shaped portion.

As also shown in FIGS. 1 and 2, the ashtray 10 includes a nub holder 42 also positioned inside the cup-shaped base portion near its upper end. FIGS. 1 and 2 illustrate one version of a nub holder that is formed as a spiral wire that reduces in diameter towards its lower end. In some embodiments, the nub holder has a diameter at its upper end of approximately 3 centimeters, has a height of approximately 4 centimeters, and has a diameter near its lower end of approximately 2 centimeters. The nub holder is preferably positioned with its upper edge at a similar height to the retaining ring 40 and is spaced from the retaining ring, such as directly opposite it. This allows the nub holder and retaining ring to be easily located and to be used at the same time. In a most preferred version, the retaining ring 40 and nub holder 42 are part of a retaining assembly that is a single continuous wire that forms both the retaining ring and the nub holder, as well as a generally C-shaped midportion extending therebetween. This retaining assembly 44 is received in a recess 46 in the inner wall of the cup-shaped base portion 12. The retaining assembly 44 is resilient such that it can be removed and replaced by squeezing the retaining ring towards the nub holder. Alternatively, the retaining assembly and/or the retaining ring and nub holder may be permanently affixed or formed in other ways.

In preferred embodiments of the present invention, all components are made from stainless steel for ease of cleaning and prevention of corrosion. Alternatively, the ashtray may be formed partially or completely of other materials, or may have an insulating layer.

As will be clear to those of skill in the art, the present invention is not limited to the embodiments disclosed and discussed herein. It is the following claims, including all equivalents, which define the scope of the present invention.

The invention claimed is:

1. A portable cigar ashtray, comprising:

a cup-shaped base portion having a closed bottom, a side wall extending upwardly from the closed bottom, and an open top;

a resting platform disposed inside the cup-shaped base portion and spaced from the closed bottom;

a retaining assembly disposed near an upper end of the cup-shaped base portion, the retaining assembly including a retaining ring and a nub holder, the retaining assembly having a first free end and an opposed second free end with a generally C-shaped midportion extending therebetween, the retaining assembly being formed of a continuous metal element with the retaining ring integrally forming the first free end and the nub holder integrally forming the second free end.

2. A portable cigar ashtray in accordance with claim 1, wherein:

the nub holder is a spiral of wire with an inward part and outward part of the spiral, the inward part being disposed lower than the outward part.

3. A portable cigar ashtray in accordance with claim 2, wherein:

the side wall of the cup-shaped base portion has a circumferential recess defined therein, the retaining assembly being received in the recess.

4. A portable cigar ashtray in accordance with claim 3, wherein:

the retaining assembly is resilient and urges the first and second free ends outwardly so as to engage the recess.

5. A portable cigar ashtray in accordance with claim 1, further comprising:

a lid that is received on the open top of the cup-shaped base portion.

6. A portable cigar ashtray in accordance with claim 5, wherein:

the side wall of the cup-shaped base portion has an upper edge, the upper edge being threaded;

the lid being threaded such that it is threadingly received on the upper edge of the side wall.

7. A portable cigar ashtray in accordance with claim 1, wherein:

the open top and the closed bottom of the cup-shaped base portion each have a diameter in the range of 5 to 10 centimeters.

8. A portable cigar ashtray in accordance with claim 7, wherein:

the open top and the closed bottom of the cup-shaped base portion each have a diameter in the range of 6 to 8 centimeters and the side wall is generally perpendicular to the closed bottom.

9. A portable cigar ashtray in accordance with claim 8, wherein:

the cup-shaped base portion has a height in the range of 8 to 12 centimeters.

10. A portable cigar ashtray, comprising:

a cup-shaped base portion having a closed bottom, a side wall extending upwardly from the closed bottom, and an open top, the side wall having a circumferential recess defined therein near the upper end of the cup-shaped base portion;

a resting platform disposed inside the cup-shaped base portion and spaced from the closed bottom;

a retaining assembly formed of a continuous metal element with a retaining ring integrally forming a first end of the retaining assembly and a nub holder integrally forming a second end of the retaining assembly, the nub holder being a spiral of wire with an inward part and outward part of the spiral, the inward part being disposed lower than the outward part, the retaining assembly further having a resilient general C-shaped midportion extending between the retaining ring and the nub holder, the retaining assembly being received in the circumferential recess in the side wall, the resilient midportion urging the first and second ends outwardly so as to engage the recess.

* * * * *